United States Patent [19]

McLaughlin et al.

[11] Patent Number: 4,512,092

[45] Date of Patent: Apr. 23, 1985

[54] REPLACEMENT LABELS FOR KEYBOARD

[75] Inventors: Thomas F. McLaughlin, Chappaqua; Gerard J. Diaz, Hastings on Hudson, both of N.Y.

[73] Assignee: Technical Support Services, Inc., Ossining, N.Y.

[21] Appl. No.: 553,524

[22] Filed: Nov. 21, 1983

[51] Int. Cl.[3] ..... A44C 3/00

[52] U.S. Cl. ..... 40/2 R; 340/365 VL; 400/493

[58] Field of Search ..... 40/331, 336, 332, 315, 40/319, 2 R; 400/493, 493.1, 493.2; 340/365 VL; 200/309; 283/61, 62

[56] References Cited

U.S. PATENT DOCUMENTS 4,010,964 3/1977 Schechter ..... 283/62

4,119,839 10/1978 Beckmann et al. ..... 340/365 VL

*Primary Examiner*—Robert P. Swiatek

*Assistant Examiner*—Cary E. Stone

*Attorney, Agent, or Firm*—Peter L. Berger

[57] ABSTRACT

A keyboard label display replacement system formed of paper strips which are placed on conventional keys arranged in a row and column matrix. Plastic caps cover the keys, and the strips of pre-folded paper are laid on top of the columns of keys to conform to the location and shape of the keys allowing replacement of the key labels to be easily achieved.

8 Claims, 4 Drawing Figures

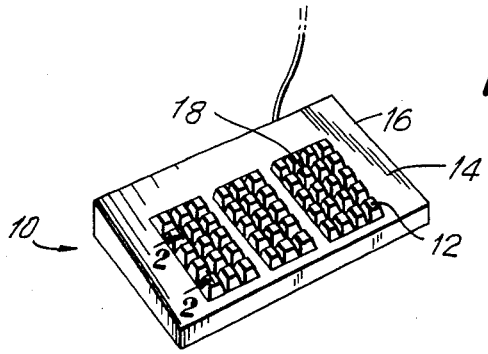
FIG. 1
FIG. 2
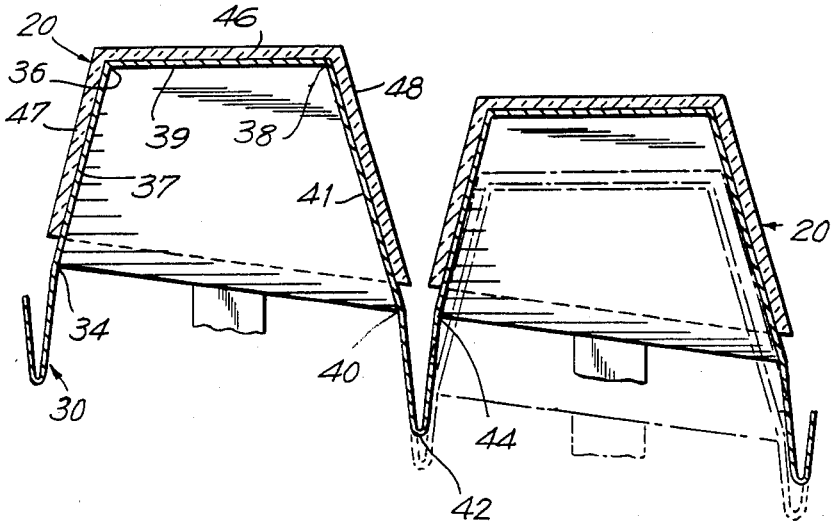
FIG. 3
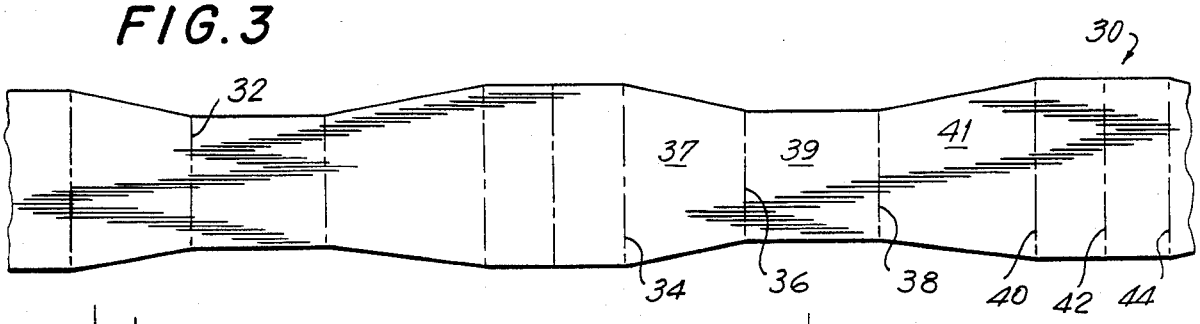
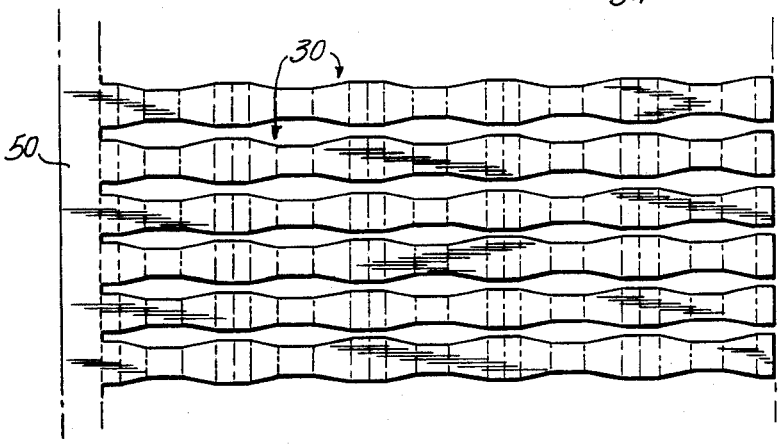
FIG. 4

REPLACEMENT LABELS FOR KEYBOARD

BACKGROUND OF THE INVENTION

This invention relates to changing labels on keys of a keyboard, and more particularly, to changing labels on keys used in IBM equipment in the banking field.

IBM along with many other manufacturers regularly supply computer keyboard and related equipment to the banking industry. The computer equipment is of a general design, and the keyboard labels may be especially tailored to specific bank needs. The function achieved with the depression of any particular key is always the same but some of the functions may change fron environment to environment. For this purpose, it is important that labels for the keys of the keyboard be readily changed.

IBM provides a clear plastic cap which generally conforms to the shape of the keys of the keyboard, the cap fitting on the key yet being easily removed. A sheet of replacement labels is supplied to the user, and individual replacement labels may be removed from the sheet. Such replacement labels merely comprises a generally rectangular label portion which has additional portions extending at its four sides allowing the label to be inserted in the cap to fit on top of the key. Generally, these replacement labels are placed in individual caps, and the caps are inserted on top of the key with the printing on the new label visible through the clear cap. The prior art placement label system is difficult to use, requiring dexterity to replace the individual replacement labels and is also extremely time consuming because each label is replaced one at a time. In many instances, entire keyboard labels have to be changed because of different functions to be accomplished by the same computer equipment.

An object of this invention is to provide replacement labels for keys of a keyboard without the cumbersome time consuming procedures previously employed.

Another object of this invention is to provide replacement labels which may conveniently cover a plurality of keys at the same time, with the ease of assembly and installation being significantly improved over the prior devices.

Still another object of this invention is to provide such a system which will readily accommodate preprinted replacement labels for entire keyboards.

Another object of this invention is to provide such a system of replacing labels which is easy to use, inexpensive to manufacture and is susceptible to widespread use.

Other objects, advantages and features of this invention will become more apparent from the following description.

SUMMARY OF THE INVENTION

In accordance with the principles of this invention, the above objects are accomplished by providing replacement labels for keys of a keyboard which use fitted caps over the keys, the replacement labels comprising strips of material which are pre-folded along crease lines, the crease lines being so disposed to conform to the location and shapes of the keys, so that the strips are merely placed over an entire row or a portion of arrow of adjacent keys of a keyboard. After being so placed on the row of keys, the plastic caps are merely placed on top of the keys, capturing the strips in the prefolded manner conforming to the key to easily display the replacement labels. The prefolded strips have a top portion adapted to fit on top of the key, this portion carrying either a blank label or preprinted label information.

This invention may also take the form of the plurality of said strips of prefolded material spaced apart from each other by the distance between adjacent rows of keys, with the plurality of said strips simultaneously covering a large number of adjacent rows of keys to change the key labels in an effective and efficient fashion.

BRIEF DESCRIPTION OF DRAWINGS

FIG. 1 is a perspective view of a keyboard utilizing this invention.

FIG. 2 is a sectional view of two adjacent keys taken along lines 2—2 of FIG. 1.

FIG. 3 is a top view of one strip of replacement labels.

FIG. 4 is a top view of a plurality of said replacement label strips.

DETAILED DESCRIPTION

FIG. 1 is a perspective view of a conventional keyboard 10 comprising a plurality of keys 12 arrayed in rows and columns. The keyboard further comprises a frame 14 for the keys and housing 16 enclosing the components operated by depressing the keys of the keyboard. When a key is depressed a corresponding switch is closed initiating a certain series of signals. The combination of keys and controlled functions may be changed by merely changing the equipment design controlled by the depression of a certain key. Thus, an add function might be controlled by the same button causing a substract function depending on the equipment connected to the keyboard.

Frequently labels 18 are carried on top of the keys to identify the function controlled. Each key itself is covered by a removable clear plastic cap 20 (FIG. 2) which is fitted to the shape of the key. In order to change the label identification on a key, the cap 20 is removed, and a new label is placed on top of the top of the key, either covering an old label or replacing a removed label. Clearly, label by label replacement is tedious, time consuming and may be difficult because conventional label replacements are supplied as individual labels on a sheet of paper to be removed from the sheet as needed. Clearly, individual label replacement is unwieldy.

FIGS. 2–4 illustrate the present invention. The present invention comprises a strip of prefolded material 30 creased along prefold lines 32 to form separate portions of the strip. In particular, prefold lines 34 and 36 define a side portion 37 adopted to fit on the side of a key in the column direction under the cap while prefold lines 36 and 38 define a top portion 39 therebetween. Crease lines 38 and 40 define the next side portion 41 along the column while crease lines 40 and 42 and 42 and 44 define a hinge connection between adjacent replacement label segments. The strips have a width to conform to the width of the key, and the strips may be contoured to conform to the key shape.

FIG. 2 illustrates the replacement label in use and the same crease or prefold lines are used as in FIG. 3 to illustrate the operation of the invention. In order to replace key labels, the plastic caps 20 are removed. The prefolded strip is then placed on the adjacent keys with the top 39 and side portions 37 and 41 of the strip fitting on to the top 46 and side segments 47 and 48, respectively of the key. Once the strips are in place, the creases tend to keep the strip in place. The caps are then placed on top of the strips capturing the strips between the cap and the key. The top portion of each strip may be preprinted or be blank as desired.

A hinge is formed between each pair of adjacent keys. The hinge comprises the strip at fold 42 which is disposed significantly below the bottom of the keys. When the key is depressed as shown in phantom lines in FIG. 2, the adjacent key is unaffected because of the depth of the hinge assembly of the strip of material.

FIG. 4 illustrates an embodiment of this convention in which a plurality of precreased strips are spaced from each other and are joined at a common header 50. With this embodiment entire keyboard labels may be readily replaced by placing each strip on a corresponding column of keys. It should be noted that one set of labels is removed while the replacement is substituted to eliminate a buildup of labels.

The strip of material may be paper, plastic or any other material which has the ability to retain the prefolded lines. In one embodiment the material is a paper having a thickness between 3–5 mils.

Although this invention has been described with one preferred embodiment, other modifications will be apparent to those of ordinary skill in the art.

What is claimed is:

1. Replacement labels for keys of a keyboard having fitted clear plastic caps fitting over said keys, said replacement labels comprising a strip of material of a length to cover at least two aligned adjacent ones of said keys, said strip of material comprising folds transverse to the direction of alignment of said adjacent keys, said folds being aligned with said keys to be fitted on and conform to the shape of said keys to fit within said fitted caps when said fitted caps are placed on said keys, the width of said strip being substantially equal to the corresponding width of said keys, said strip comprising a material which retains said folds, the length of said strip of material between adjacent keys including at least one of said folds and being greater than the vertical movement of said keys such that at least said one fold in said strip comprises hinge means enabling one key to be depressed independent of the adjacent key without tearing said strip.

2. Replacement labels as claimed in claim 1, wherein said strip comprises a paper material.

3. Replacement labels as claimed in claim 2, wherein said paper has a thickness of between 3 and 5 mils.

4. Replacement labels as claimed in claim 1, wherein said keys are arrayed in rows and columns, wherein said strip extends along at least one column of said keys

5. Replacement labels as claimed in claim 4, further comprising a plurality of said strips connected at one end, said strips being parallel to each other and being separated from each other by the distance between adjacent columns of said keys, said strips covering parallel rows of said keys.

6. Replacement labels as claimed in claim 5, wherein said strips are preprinted with symbols at key locations to be covered by said strips.

7. Replacement labels as claimed in claim 5, wherein said folds in said strip comprise hinge means enabling one key to be depressed without depressing said adjacent key.

8. Replacement labels as claimed in claim 1, wherein said strips are preprinted with symbols at key locations to be covered by said strips.

* * * * *